US009759147B2

(12) United States Patent
Walz et al.

(10) Patent No.: US 9,759,147 B2
(45) Date of Patent: Sep. 12, 2017

(54) IDLE RETURN SYSTEM AND METHOD FOR AN OFF HIGHWAY VEHICLE

(71) Applicant: CNH Industrial America LLC, New Holland, PA (US)

(72) Inventors: Robert Walz, Burlington, IA (US); Nicholas S. Chibucos, Burlington, IA (US)

(73) Assignee: CNH Industrial America LLC, New Holland, PA (US)

( * ) Notice: Subject to any disclaimer, the term of this patent is extended or adjusted under 35 U.S.C. 154(b) by 159 days.

(21) Appl. No.: 14/473,442

(22) Filed: Aug. 29, 2014

(65) Prior Publication Data

US 2016/0061133 A1 Mar. 3, 2016

(51) Int. Cl.

| | |
|---|---|
| ***F02D 41/08*** | (2006.01) |
| ***E02F 9/20*** | (2006.01) |
| ***E02F 9/22*** | (2006.01) |
| ***F02D 29/04*** | (2006.01) |
| ***F02D 41/02*** | (2006.01) |
| ***E02F 3/96*** | (2006.01) |
| ***E02F 9/16*** | (2006.01) |
| *F02D 29/02* | (2006.01) |
| *F02D 41/14* | (2006.01) |

(52) U.S. Cl.

CPC ..... *F02D 41/083* (2013.01); *E02F 3/964* (2013.01); *E02F 9/166* (2013.01); *E02F 9/2066* (2013.01); *E02F 9/2246* (2013.01); *F02D 29/04* (2013.01); *F02D 41/021* (2013.01); *F02D 29/02* (2013.01); *F02D 2041/1411* (2013.01)

(58) Field of Classification Search

CPC ..... F02D 41/083; F02D 41/021; F02D 29/04; F02D 2041/1411; F02D 29/02; E02F 9/2066; E02F 9/2246

USPC ..... 123/339.16, 339.18, 69.3; 701/50, 102, 701/103, 112

See application file for complete search history.

(56) References Cited

U.S. PATENT DOCUMENTS

| | | | | |
|---|---|---|---|---|
| 4,748,951 | A | 6/1988 | Manaka et al. | |
| 5,586,536 | A | 12/1996 | Seo et al. | |
| 5,666,917 | A | 9/1997 | Fraser et al. | |
| 5,967,758 | A | 10/1999 | Fujii et al. | |
| 6,694,240 | B1 | 2/2004 | Swick et al. | |
| 6,857,987 | B2 | 2/2005 | Aldrich, III et al. | |
| 7,665,971 | B1 | 2/2010 | Glickman et al. | |
| 7,702,450 | B2 | 4/2010 | Pfohl et al. | |
| 8,041,485 | B2 | 10/2011 | Prasetiawan et al. | |
| 8,892,339 | B2 * | 11/2014 | Ma | F02D 29/02 701/113 |
| 2011/0005024 | A1 * | 1/2011 | Spitler | B08B 3/026 15/320 |

(Continued)

FOREIGN PATENT DOCUMENTS

| | | | |
|---|---|---|---|
| CN | 102383453 | A | 3/2012 |
| JP | 2001123859 | A | 5/2001 |
| WO | 2013/078915 | A1 | 6/2013 |

*Primary Examiner* — Joseph Dallo

(74) *Attorney, Agent, or Firm* — Patrick M. Sheldrake

(57) ABSTRACT

An engine idle control method of an off highway vehicle. The method including the steps of: detecting a static load on the engine; detecting a dynamic load on the engine; determining if the static load is below a predetermined static level; determining if the dynamic load is less than a predetermined range; and engaging an auto-idle feature dependent upon both of the determining steps being true.

20 Claims, 3 Drawing Sheets

(56) References Cited

U.S. PATENT DOCUMENTS

| | | | | |
|---|---|---|---|---|
| 2011/0088658 | A1 | 4/2011 | Chan et al. | |
| 2011/0214641 | A1* | 9/2011 | Vaughn | F02D 31/00 123/376 |
| 2011/0295474 | A1* | 12/2011 | Ma | F02D 29/02 701/58 |
| 2013/0041561 | A1 | 2/2013 | Asami et al. | |
| 2013/0282242 | A1* | 10/2013 | Park | F02D 29/02 701/50 |
| 2013/0325293 | A1 | 12/2013 | Jacobson | |
| 2013/0333664 | A1 | 12/2013 | Killion et al. | |
| 2014/0008140 | A1* | 1/2014 | Yoshida | F01N 3/0231 180/309 |
| 2014/0290237 | A1* | 10/2014 | Yoshida | F02D 41/029 60/452 |
| 2014/0343829 | A1* | 11/2014 | Park | F02D 41/021 701/110 |
| 2015/0176249 | A1* | 6/2015 | McKee | B60K 26/02 180/330 |

* cited by examiner

Specific Example:
X = 60%
Y = 15%
Z = 0.25 Seconds

IDLE RETURN SYSTEM AND METHOD FOR AN OFF HIGHWAY VEHICLE

BACKGROUND OF THE INVENTION

1. Field of the Invention

The present invention relates generally to the field of work machines. It relates more particularly to work machines with hydraulic systems.

2. Description of the Related Art

Off highway vehicles include construction equipment such as a backhoe loader, also called a loader backhoe, or shortened to "backhoe" within the common language of the industry, is a vehicle that includes a tractor like unit fitted with a bucket loader on the front and a backhoe on the back. Due to its size and versatility, backhoe loaders are very commonly used in agricultural pursuits as well as construction projects. The backhoe loader is also known as a TLB (Tractor-Loader-Backhoe), which is to say, a tractor fitted with a front loader and a rear backhoe attachment.

Backhoe loaders are very common and can be used for a wide variety of tasks such as: construction, small demolitions, the transportation of building materials, powering a variety of building equipment, digging holes/excavation, landscaping, breaking asphalt, and paving roads. Advantageously, the backhoe bucket can also be replaced with a variety of attachments including powered attachments such as a grapple, an auger, or a stump grinder.

The relatively small frame and precise control make backhoe-loaders very useful in areas that are too small for larger equipment. Their versatility and compact size makes them one of the most popular urban construction vehicles. For larger projects, a tracked excavator is generally used.

Vehicles, such as those used in the agricultural, forestry and construction industries are typically controlled by an operator sitting at an operator station. In the operation of the equipment there may be times in which the engine is set to run at a throttle speed that is unneeded when operations cease or are limited. For example, a backhoe may be used to dig a trench and while the operator is waiting for a depth check of the trench, the controls are not being directed to do any work so the operator manually reduces the engine speed to idle, to thereby reduce fuel consumption.

What is needed in the art is a control system that allows precise, reliable, detection of loads on the engine and controls an auto-idle feature without adding new sensors to the system.

SUMMARY OF THE INVENTION

The present invention is directed to a vehicle control system that detects engine load and executes an auto-idle control of the engine speed.

The present invention consists in one form thereof of an engine idle control method for an off highway vehicle. The method including the steps of: detecting a static load on the engine; detecting a dynamic load on the engine; determining if the static load is below a predetermined static level; determining if the dynamic load is less than a predetermined range; and engaging an auto-idle feature dependent upon both of the determining steps being true.

The present invention consists in another form thereof of an off highway vehicle including a chassis, an engine carried by the chassis and a controller in communication with the engine. The controller is configured to execute an engine idle control method that includes the steps of: detecting a static load on the engine; detecting a dynamic load on the engine; determining if the static load is below a predetermined static level; determining if the dynamic load is less than a predetermined range; and engaging an auto-idle feature dependent upon both of the determining steps being true.

An advantage of the present invention is that it provides additional features for the vehicle without the need for additional sensors.

Another advantage of the present invention is that it saves fuel.

Yet another advantage of the present invention is that it reduces engine wear.

Yet another advantage of the present invention is that it is responsive to the actions of the operator in an automated fashion.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates an embodiment of the invention, in one form, and such exemplification is not to be construed as limiting the scope of the invention in any manner.

DETAILED DESCRIPTION OF THE INVENTION

Figure 1:
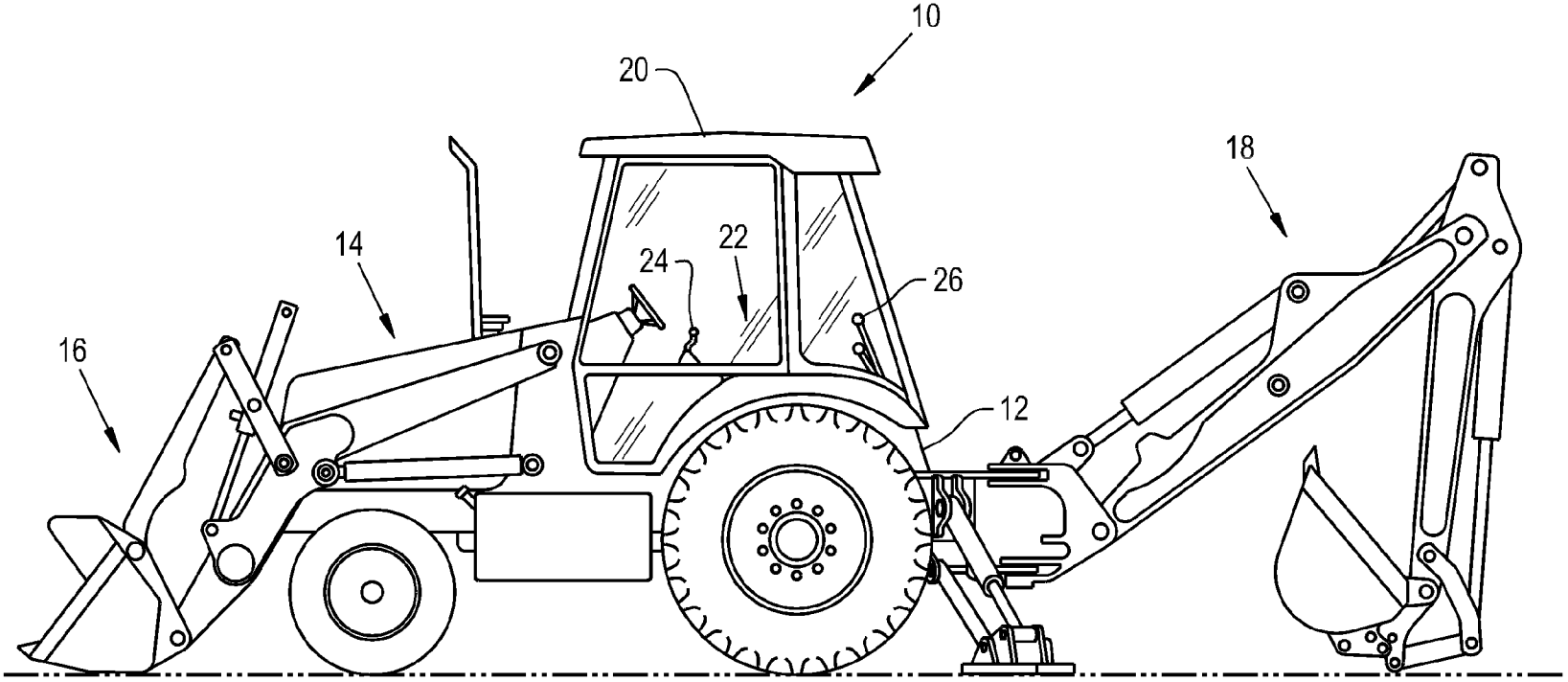
FIG. 1 is a side view of a vehicle in the form of a backhoe that utilizes an embodiment of a load detection method of the present invention for carrying out an auto-idle feature.

Referring now to the drawings, and more particularly to FIG. 1, there is shown an earth-working machine 10, referred to herein as a backhoe 10 that employs the present invention. Backhoe 10 includes a chassis 12 that carries an engine 14. A loader is operatively positioned on the front of backhoe 10 and a hoe 18 is coupled to the back of vehicle 10. Vehicle 10 additionally has a cab 20 with a seat 22, a throttle 24 and hydraulic controls 26 therein. Additionally, there is a gear selector in the form of a FNR (Forward, Neutral, Reverse) transmission control and a BEI (Brake Enabled Idle) control, in cab 20, although not separately illustrated.

Engine 14 includes an Engine Control Unit (ECU), which can be thought of as a controller that carries out control functions of engine 14 and receives input from sensors associated with the engine or from other sensors positioned about backhoe 10. The controller executes programming instructions, such as those illustrated in FIGS. 2 and 3.

The present invention presents a method to control engine speed, such that engine 14 is automatically idled down during a period of disuse, and working speed is resumed thereafter, when vehicle 10 is being used in stationary operations. Software methods utilize existing vehicle and engine signals, and requires no additional sensors for operation.

Off Highway Industrial Vehicles, in particular Tractor Loader Backhoe 10, are frequently utilized in stationary applications, where work cycles include intermittent intervals of material handling followed by idle periods. It is customary for the operator to statically set the engine throttle to a high power output position to accomplish this work. During the idle periods, in such stationary operations, it is desired to automatically reduce the engine speed, to reduce fuel consumption, emissions, noise, and wear on the machine. When the operator commands the machine back to working status (for example, by activating a hydraulic digging function), it is desired that the engine speed automatically return to the high output state.

Figure 2:
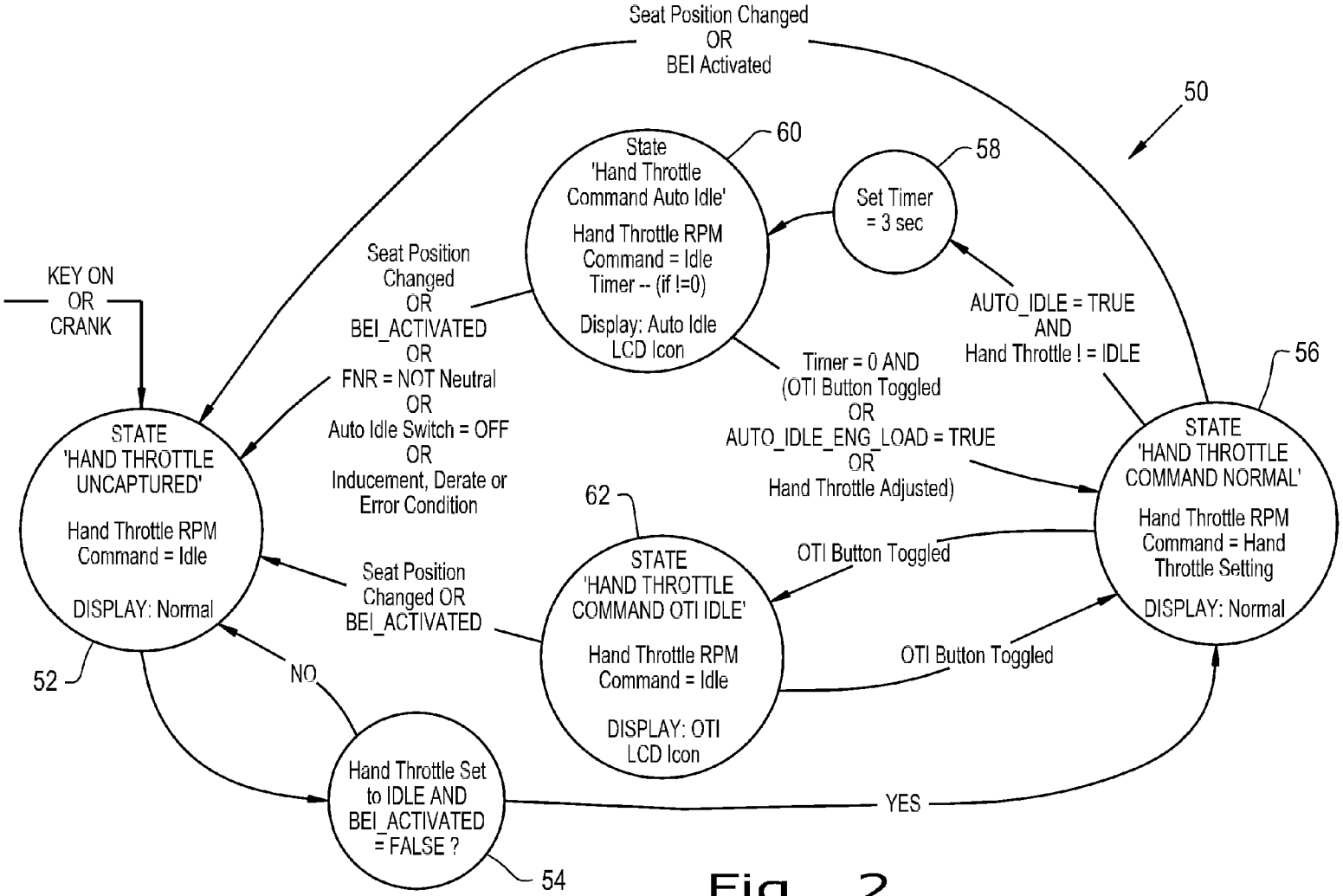
FIG. 2 is a state diagram that illustrates the logic of the auto-idle feature used with the vehicle of FIG. 1.

FIG. 2 illustrates a state diagram illustrating a vehicle state 50 that provides a visual guide to the functions of the present invention. In state 52 (Hand Throttle Uncaptured) throttle 24 is disregarded and the visual display to the operator is normal with the engine running (or the key has just been activated). In state 54 the combination of the throttle 24 setting and the variable BEI_Activated are tested. If throttle 24 is not set to idle, then vehicle state 50 transitions to state 52. Else if the variable BEI_Activated is TRUE (meaning Brake Enabled Idle set to Allowed by the operator and the service brakes have been activated), then vehicle state 50 transitions to state 52. Else if the preceding conditions are met (throttle 24 is set to idle AND BEI_Activated is FALSE), then vehicle state 50 transitions to state 56.

In state 56 (Hand Throttle Command Normal) throttle 24 is set to a command RPM, at which the ECU strives to maintain engine 14, and the display is normal. If the One Touch Idle (OTI) button is toggled then vehicle state 50 transitions to state 62. If the position of seat 22 is changed or BEI_Activated becomes TRUE then vehicle state 50 transitions to state 52. If from state 56, the variable AUTO_IDLE=TRUE and throttle 24 is not set to Idle then vehicle state 50 transitions to state 58.

In state 58 a timer is initialized for a predetermined amount of time, such as 3 seconds, which allows a settling time in the system. This timer counts in state 60 and is used as a gating condition to exit state 60 and transition to state 56.

In state 60 (Hand Throttle Command Auto Idle) the RPM command is Idle and the Display displays an Auto Idle icon. If timer 58 is expired, and one of the following occurs: the OTI button is toggled, or AUTO_IDLE_ENG_LOAD is TRUE, or throttle 24 is adjusted then vehicle state 50 transitions to state 56. If, in state 60, the position of seat 22 is changed, or BEI_Activated becomes TRUE, or FNR (Forward-Neutral-Reverse) is NOT Neutral, or the Auto Idle Switch is OFF, or there is an inducement, a derate (limited engine performance) or error condition then vehicle state 50 transitions to state 52.

In state 62 (Hand Throttle Command OTI Idle), the RPM command is Idle and the Display displays an OTI icon. If the OTI button is toggled then vehicle state 50 transitions to state 56. If the position of seat 22 is changed or BEI_Activated becomes TRUE then vehicle state 50 transitions to state 52.

Figure 3:
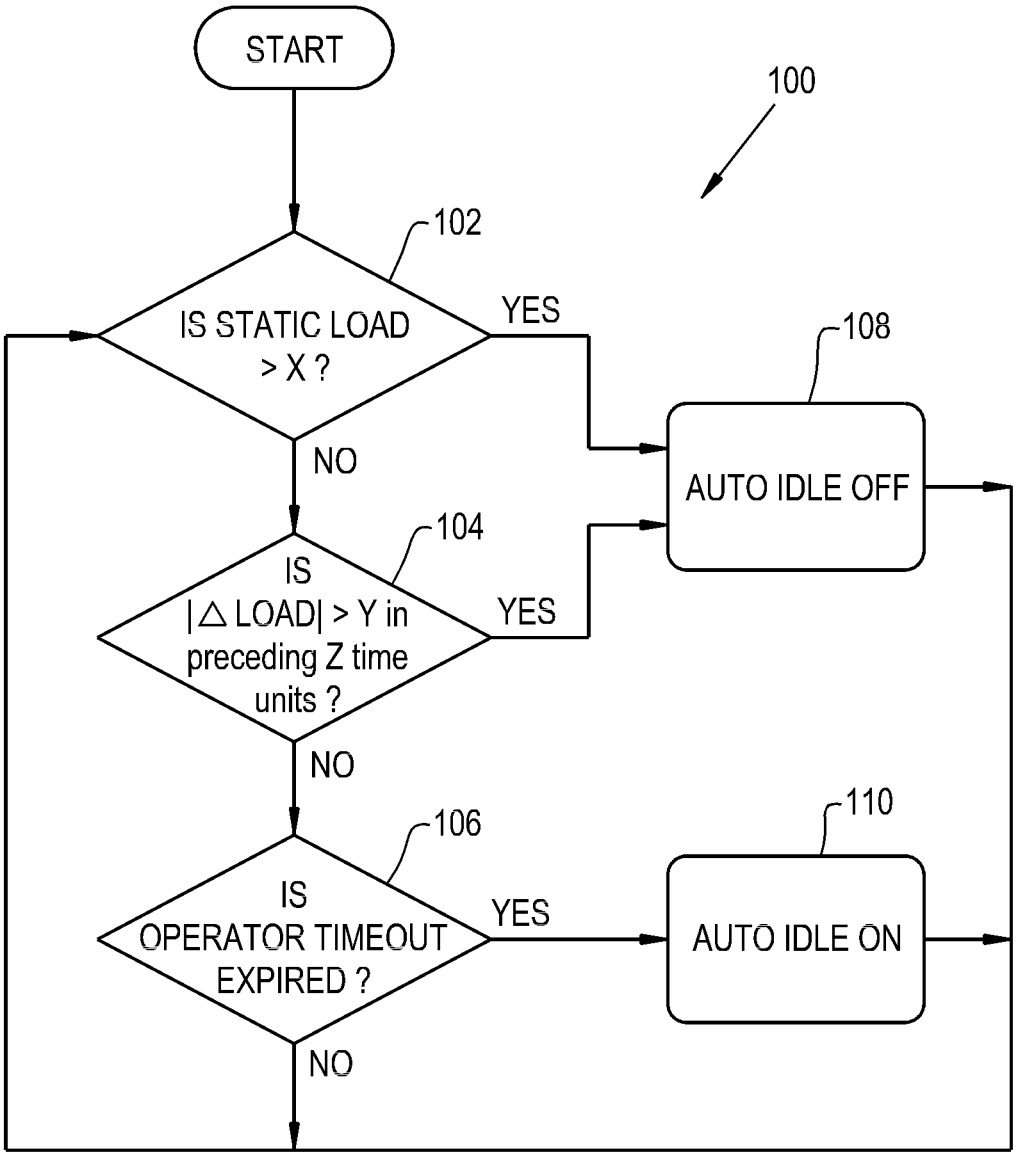
FIG. 3 is a flowchart that details steps of the load detection method used as an input to the auto-idle system shown in FIG. 2 for the vehicle of FIG. 1.

FIG. 3 is a flowchart providing another view of the present invention and that illustrates the steps taken to determine whether to engage the auto-idle feature discussed herein. Method 100 includes steps 102, 104, 106, 108 and 110. At step 102 the ECU determines if engine 14 is experiencing a static load greater than X, which can be, for the sake of discussion, a 60% load value, which is an input variable available to the ECU. If the static load is greater than X, then method 100 proceeds to step 108 ensuring that the Auto-Idle is OFF. However, if the static load is not greater than X, then method 100 proceeds to step 104 where a further load determination is carried out by determining if there is a dynamic load above a predefined value. Here the load delta is determined to see if it is varying by more than a value Y over the preceding Z time units, Z being a moving time window of the most recent load data up until the present instant. For the purposes of illustration Y may be 15% and Z may be 0.25 second. If the dynamic load exceeds 15% within the last 0.25 second, then method 100 proceeds to step 108, where the Auto-Idle feature is turned OFF. If the dynamic load does not exceed 15% then method 100 proceeds to step 106.

At step 106 the ECU determines whether an operator timeout has expired. This is a predetermined time, that may be set by the operator, and if the time has elapsed, method 100 proceeds to set the Auto-Idle to ON. If the operator timeout has not expired then method 100 returns to step 102 and the static and dynamic loads are again checked. It is contemplated that the values for X, Y, Z, and the operator timeout can be other than those values discussed herein and may be selectable by an operator or an authorized person. It is further contemplated that the ECU may assume different values for one or more of X, Y, Z, depending on the present condition of Auto-Idle, for example, Auto-Idle OFF or Auto-Idle ON.

Advantageously the present invention uses the ECU to carry out the method of the invention and requires no additional sensors for operation. The present invention more reliably detects idle and working conditions at lightly loaded engine conditions versus a fixed threshold engine load detection system. It is contemplated that the present invention may be carried out using mechanical, hydro-mechanical, pneumatic, analog electrical/electronic and/or digital control elements.

Advantageously the present invention does not require dedicated motion, load, or pressure sensors to determine the working or non-working condition of the machine. The present invention addresses these shortcomings, as well as provides a method to more reliably detect idle or working conditions at lightly loaded engine conditions.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An off highway vehicle, comprising:

a chassis;

an engine carried by said chassis; and a controller in communication with said engine, said controller being configured to execute an engine idle control method that includes the steps of:

detecting a static load on the engine;

detecting a dynamic load on the engine;

determining if said static load is below a predetermined static level;

determining if said dynamic load is less than a predetermined range;

engaging an auto-idle feature dependent upon both of said determining steps;

disengaging said auto-idle feature if either of said determining steps are not true; and returning an engine speed of the engine to correspond to a throttle setting when said disengaging step determines that at least one of the determining steps are not true.

2. The off highway vehicle of claim 1, wherein said engaging step of said method is not carried out unless service brakes are activated on the vehicle.

3. The off highway vehicle of claim 2, wherein said service brakes are considered set when a brake enabled idle variable is set.

4. The off highway vehicle of claim 1, wherein said method further includes the step of delaying said engaging step until a predetermined time has expired from a time in which said static load is below said predetermined static level and said dynamic load is less than said predetermined range.

5. The off highway vehicle of claim 1, wherein said determining if said dynamic load is less than a predetermined range step includes a substep of ensuring that said dynamic load is less than said predetermined range for a predetermined time period.

6. The off highway vehicle of claim 5, wherein said predetermined time period is less than one second.

7. The off highway vehicle of claim 6, wherein said predetermined time period is approximately 250 msec.

8. The off highway vehicle of claim 1, wherein said method further includes the step of disengaging said auto-idle feature when an interrupting event is detected.

9. The off highway vehicle of claim 8, wherein said interrupting event is a seat position change by an operator.

10. The off highway vehicle of claim 8, wherein said interrupting event is one of a change of a throttle setting, a gear selector not being in a neutral selection, and a one touch idle being activated.

11. An engine idle control method of an off highway vehicle, the method comprising the steps of:

detecting a static load on the engine;

detecting a dynamic load on the engine;

determining if said static load is below a predetermined static level;

determining if said dynamic load is less than a predetermined range; and engaging an auto-idle feature dependent upon both of said determining steps.

12. The method of claim 11, further comprising the step of disengaging said auto-idle feature if either of said determining steps are not true.

13. The method of claim 12, wherein said disengaging step includes the step of returning the engine speed to correspond to a throttle setting.

14. The method of claim 12, further comprising the step of delaying said engaging step until a predetermined time has expired from a time in which said static load is below said predetermined static level and said dynamic load is less than said predetermined range.

15. The method of claim 12, wherein said determining if said dynamic load is less than a predetermined range step includes a substep of ensuring that said dynamic load is less than said predetermined range for a predetermined time period.

16. The method of claim 15, wherein said predetermined time period is less than one second.

17. The method of claim 16, wherein said predetermined time period is approximately 250 msec.

18. The method of claim 11, further comprising the step of disengaging said auto-idle feature when an interrupting event is detected.

19. The method of claim 18, wherein said interrupting event is a seat position change by an operator.

20. The method of claim 18, wherein said interrupting event is one of a change of a throttle setting, a gear selector not being in a neutral selection, and a one touch idle being activated.

* * * * *